US008291792B2

(12) United States Patent
Yang

(10) Patent No.: US 8,291,792 B2
(45) Date of Patent: Oct. 23, 2012

(54) RACHET WRENCH

(76) Inventor: Cheng-Pu Yang, Changhua County (TW)

( * ) Notice: Subject to any disclaimer, the term of this patent is extended or adjusted under 35 U.S.C. 154(b) by 135 days.

(21) Appl. No.: 13/014,703

(22) Filed: Jan. 26, 2011

(65) Prior Publication Data

US 2012/0186402 A1 Jul. 26, 2012

(51) Int. Cl.
*B25B 13/46* (2006.01)

(52) U.S. Cl. ..... 81/63.2; 81/63.1; 81/60

(58) Field of Classification Search ..... 81/58–63.2, 81/186; 192/43–44
See application file for complete search history.

(56) References Cited

U.S. PATENT DOCUMENTS 6,584,875 B1 * 7/2003 Deng ..... 81/63.1
7,444,903 B1 * 11/2008 Li ..... 81/60
* cited by examiner

*Primary Examiner* — Monica Carter
*Assistant Examiner* — Melanie Alexander

(57) ABSTRACT

The present invention relates a ratchet wrench which comprises a main body, a ratchet wheel, a pawl, an elastic element and a clip. The main body has a first housing and a second housing. The ratchet wheel is rotatably lodged within the first housing and has a plurality of ratchet teeth. The pawl is confined within the second housing and a plurality of first retaining cogs and curved second retaining cogs are successively arranged on the front side of the pawl. The first and the second retaining cogs are defined to engage with the ratchet teeth. A recess, a first convex surface and a second convex surface are defined on the pawl. The second convex surface abuts against the wall of the second housing. The elastic element pushes the pawl with a particular angle so that the second convex surface is forced to abut against the wall of the second housing and the cogs of the pawl are engaged with the ratchet teeth.

10 Claims, 11 Drawing Sheets

RACHET WRENCH

FIELD OF THE INVENTION

The present invention relates to a ratchet wrench, particularly to a single direction ratchet wrench with lower manufacturing cost and durable mechanism.

BACKGROUND OF THE INVENTION

According to the prior art of a single direction ratchet wrench disclosed in U.S. Pat. No. 5,979,274, it comprises a main body whose two ends are one handle and one function end respectively. The function end has a first housing with a ratchet wheel allocated inside, a second housing caved in the inner wall of the first housing, a pawl confined in the second housing, and an elastic element lodged in a recess. When the elastic element pushes the pawl, the retaining cogs of the pawl and the ratchet teeth of the ratchet wheel are engaged together. Nevertheless, the recess to lodge the elastic element is drilled in the curved wall of the second housing. During manufacturing, the drill bit has to reach in the second housing with a bevel angle, in order to avoid contacting with the wall of the first housing, and drills a slanted recess from the curved wall of the second housing. Not only is the process difficult, but the elastic element lodged in the recess tends to be slantwise and poorly functioned.

Another prior art of a single direction ratchet wrench disclosed in U.S. Pat. No. 7,444,903 B1, it comprises a main body, a pawl, a ratchet wheel, a spring, a C-shape clip and a position ring. The main body has a first housing at its one end and a curved second housing in the wall of the first housing. An annular trough is at the top portion of the first housing and an annular flange at the bottom. The pawl is arc shaped. Its front side is a concave surface which has retaining cogs and a sliding surface successively arranged on it, and its rear side, opposite to the retaining cogs, has a limit surface and, opposite to the sliding surface, links with a spring. Both the top and the bottom portions of the ratchet wheel have an annular groove, and the two annular grooves allow the annular flange and the position ring to lodge in respectively. A C-shape clip clamps the ring and the groove tightly so that the ratchet wheel is positioned within the first housing by the concealed ring. This prior art does not require drilling a recess in the second housing to lodge the spring, but it still has following disadvantages:

1. It comprises six components: a main body, a pawl, a ratchet wheel, a spring, a C-shape clip and a position ring. The more the components are, and the higher the assembly cost is.

2. It still requires drilling a hole on the rear side of the pawl for the spring to be lodged. Because the rear side of the pawl is a curve, it makes the drilling much more difficult, especially at the summit of the curve. When the drill bit is spinning at a high speed and contacting with the surface of the curve, it is easily displaced along the curve. Therefore, it makes the drilling inaccurate as well and possibly damages the hole and the bit.

3. The recess to lodge the spring is located on the rear side, close to the middle portion, of the pawl in order for the pawl to be completely pushed and engaged with the ratchet wheel, but the spring does not have enough elasticity to disengage the pawl. In this case, it will cause the pawl to still engage with the ratchet wheel when the wrench is revolved in opposite direction and the wrench is unable to be revolved counterclockwise against the ratchet wheel.

4. The depth of the recess is limited, and so is the length of the spring. Therefore, the spring can only supply insufficient elasticity and cause the interaction between the pawl and the ratchet wheel uneven.

SUMMARY OF THE INVENTION

The object of the present invention is to provide a single direction ratchet wrench which has improved effectiveness of single direction control and also has advantages of simplified components, easier assembly and reduced cost. In order to achieve the foregoing object, a ratchet wheel comprises a main body, a ratchet wheel, a pawl, an elastic element and a C-shape clip. The function end of the main body has a first housing and a second housing for the ratchet wheel and the pawl to be confined within respectively. There is a clamping trough and an annular groove notched at the top and the bottom peripheries of the ratchet wheel respectively. The clamping trough is exactly paired with an annular trough for the clip to clamp and the annular groove allows an annular flange to be engaged, at the bottom of the first housing, for the ratchet wheel to be rotatably lodged within the first housing. A plurality of first retaining cogs, curved second retaining cogs and a first concave surface are successively arranged on the front side of the pawl, and they are distributed along a first arc. The central angle of the second retaining cogs extended along the first arc is less than or equal to 20 degrees. On the rear side of the pawl is a first convex surface whose one end extends a second convex surface and the other end extends a recess. The second convex surface abuts against the wall of the second housing, and the recess allows one end of the elastic element to lodge in. The second convex surface spans between 10 to 20 degrees of the first arc's central angle, and it is on a second arc. Between a distal end, which is an adjacent end of the first convex surface and the recess, and the second arc is a gap which is larger than the depth of the retaining cogs.

DETAILED DESCRIPTION OF THE PREFERRED EMBODIMENT

Figure 1:
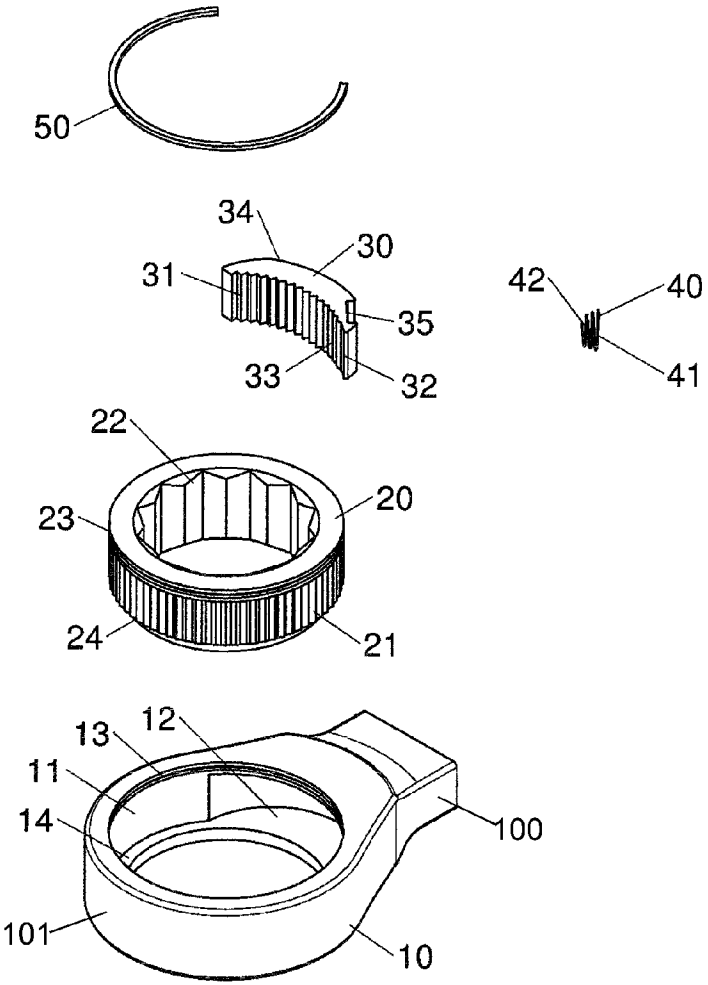
FIG. 1 is an exploded perspective view of the present invention.
Figure 2:
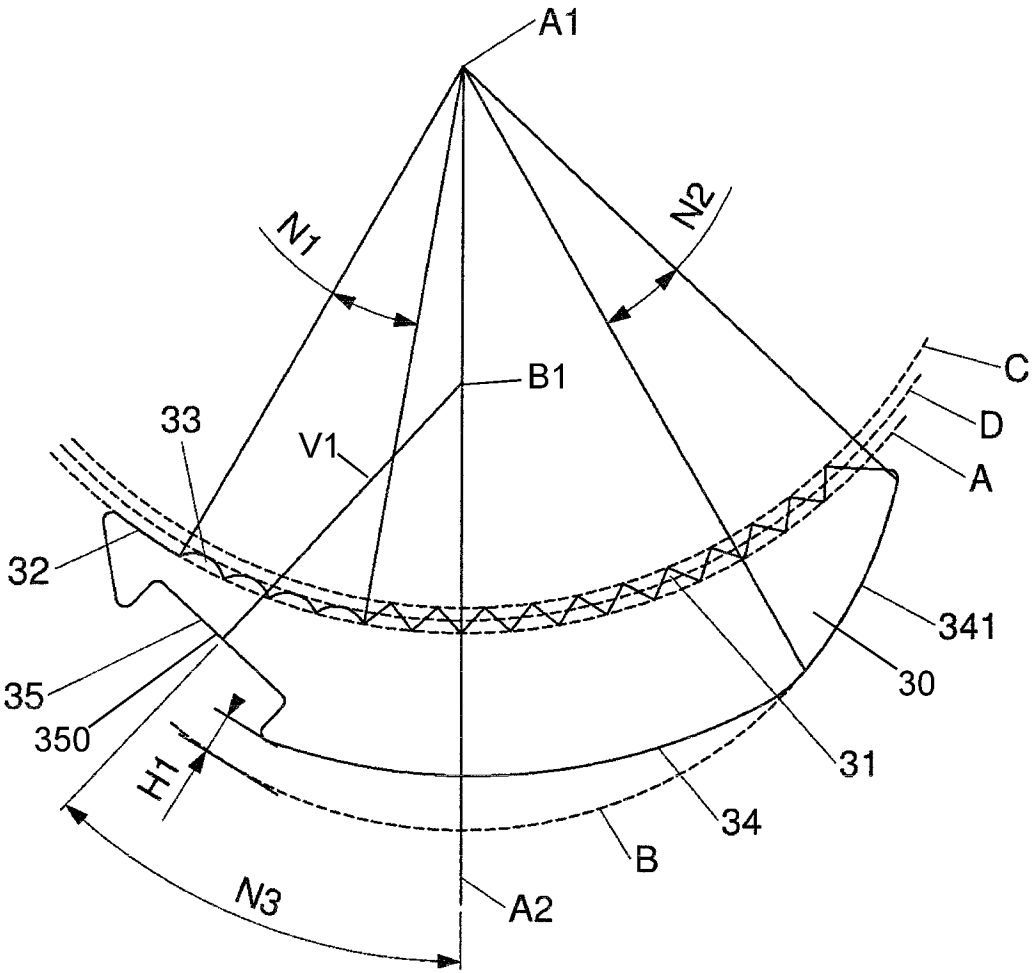
FIG. 2 is a schematic drawing of the pawl in accordance with the present invention.
Figure 3:
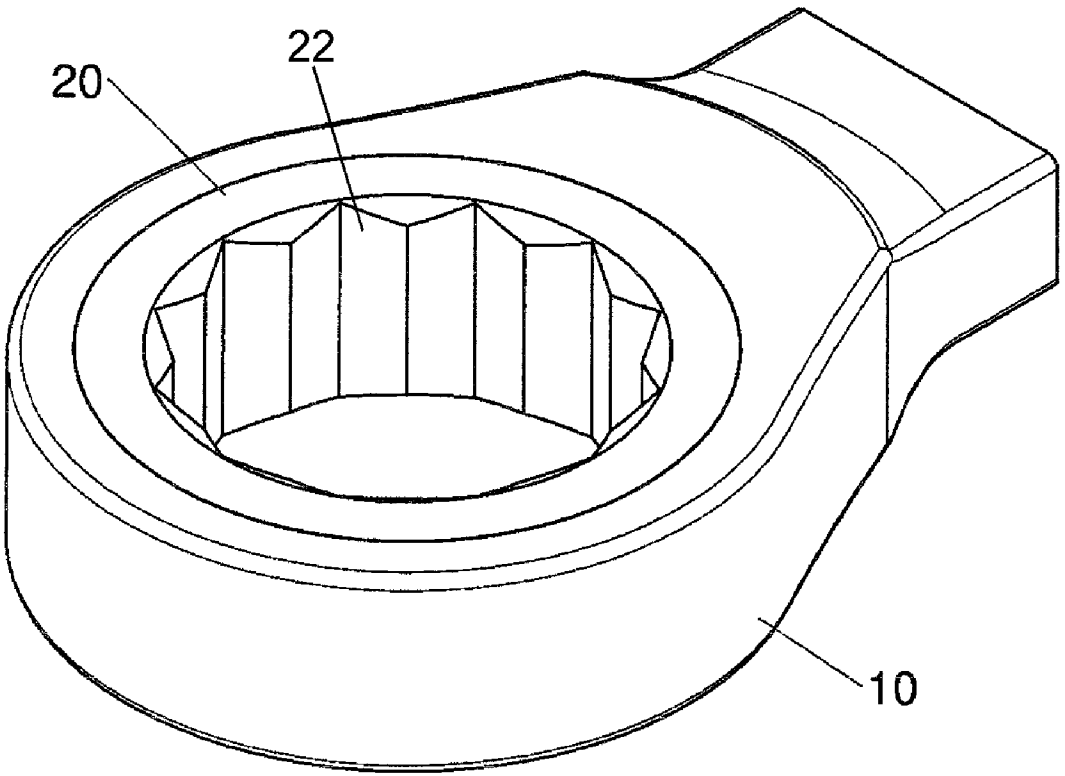
FIG. 3 is a perspective assembly view of the present invention.

Referring to FIGS. 1 to 3, the ratchet wheel of the present invention comprises a main body 10, a ratchet wheel 20, a pawl 30, an elastic element 40 and a clip 50. Their mechanism is detailed as below:

a main body 10 having a handle 100 at one end and a function end 101 at the other; the function end 101 having a round first housing 11 opened in its middle; on one side wall of the first housing 11 close to the handle 100 being sunk a curved second housing 12 which communicates with the first housing 11 and has a smaller diameter; the center of the second housing 12 being located inside the first housing 11 and the top and the bottom portions of the second housing 12 being confined, and an annular trough 13 being at the top portion of the first housing 11 and an annular flange 14 at the bottom;

a ratchet wheel 20 being rotatably mounted in the first housing 11; the outer periphery of the ratchet wheel 20 having a plurality of ratchet teeth 21 annularly arranged at its middle portion; the center of the ratchet wheel 20 having a couple portion 22 which, shown as drawings, is a polygonal opening for a workpiece to be coupled; a clamping trough 23 and an annular groove 24 being respectively notched at the top and the bottom portions of the outer peripheries of the ratchet wheel 20, the clamping trough 23 being exactly paired with the annular trough 13, and the annular groove 24 allowing the annular flange 14 to be engaged in;

a pawl 30 lodged in the second housing 12 having a plurality of first retaining cogs 31 with sharp teeth, a plurality of curved second retaining cogs 33 (in this preferred embodiment, there are four second retaining cogs 33) with arched teeth and a first concave surface 32 successively arranged on its front side and distributed along a first arc A which has the same diameter as the first housing 11; the first retaining cogs 31 and the second retaining cogs 33 being defined to engage with the ratchet teeth 21, wherein the arched second retaining cogs 33 having the function of helping the first retaining cogs 31 easier to disengage from the ratchet teeth 21; the tips of the first retaining cogs 31 distributing on a third arc C and the tips of the second retaining cogs 33 distributing on a fourth arc D (in a better embodiment the diameter of the arc D is half of the sum of the arc A's and the arc C's); at least two teeth of the first retaining cogs 31 passing a bisector A2 of the first arc A and being followed by the second retaining cogs 33 as the pawl 30 and the ratchet wheel 20 being effectively engaged together, the central angle N1 of the second retaining cogs 33 extended along the first arc A being less than or equal to 20 degrees; on the rear side of the pawl 30 being a first convex surface 34 which has a first end and a second end defined in opposite directions, the first end extending a second convex surface 341 towards the front side of the pawl 30 and the second end extending a recess 35, the second convex surface 341 spanning between 10 to 20 degrees of the central angle N2 with respect to the center of the first arc A; the second convex surface 341 being on a second arc B and against the wall of the second housing 12 as the pawl 30 and the ratchet wheel 20 being effectively engaged together; the second arc B having the same diameter as the second housing 12, between the second arc B and the end of the first convex surface 34 adjacent to the recess 35 being a gap H1 which is larger than the depth of the first retaining cogs 31, the rear side of the recess 35 being corresponding to the second retaining cogs 33 as the pawl 30 and the ratchet wheel 20 being effectively engaged together; a normal V1 extended from the middle of the bottom of the recess bottom 350 passing through the center of the second arc B, the normal V1 and the bisector A2 of the first convex surface 34 having an included angle N3 which is greater than or equal to 40 degrees;

an elastic element 40 having a first end 41 and a second end 42, the outer diameter of the first end 41 being greater than or equal to the vertical depth of the second housing 12 in order for the first end 41 to be held against the second housing 12 and for the second end 42 to lodge in the recess 35 of the pawl 30 and to abut against the recess bottom 350, and the elastic element 40 pushing the pawl 30 so that the second convex surface 341 being forced to abut against the wall of the second housing 12 and the first retaining cogs 31 of the pawl 30 being engaged with the ratchet teeth 21; and a clip 50 being lodged in both the annular trough 13 and the clamping trough 23 for the ratchet wheel 20 to be held within the first housing 11.

Figure 4:
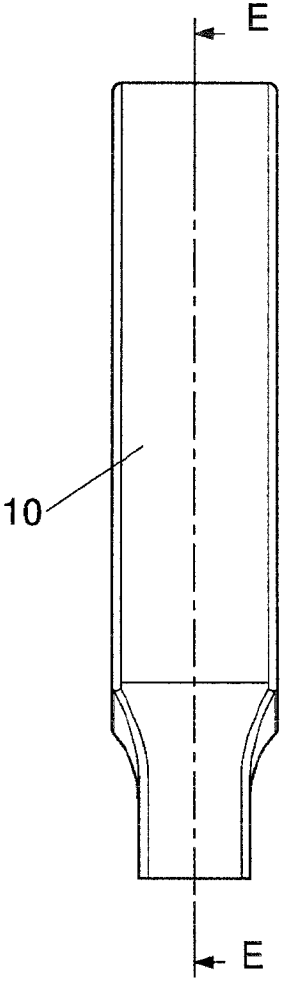
FIG. 4 is a side view of the present invention.
Figure 5:
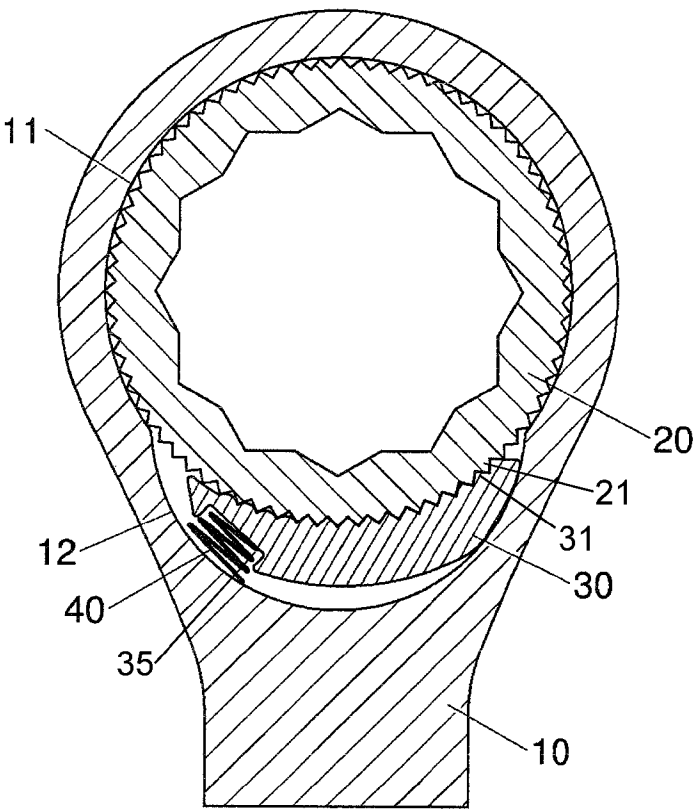
FIG. 5 is a cross-sectional view taken along plane E-E in FIG. 4.
Figure 8:
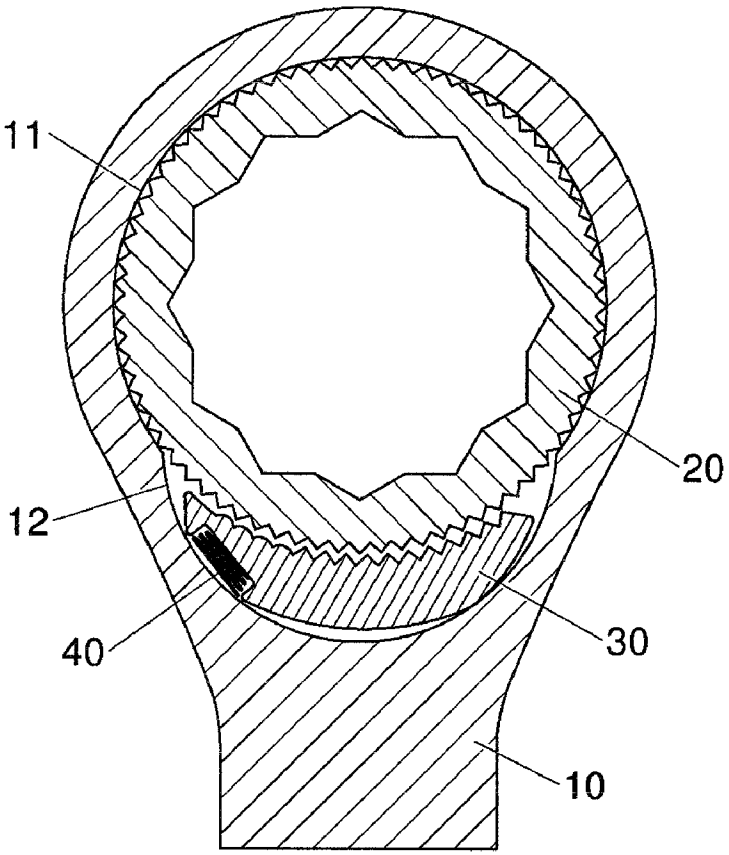
FIG. 8 is a cross sectional view of the pawl disengaging from the ratchet wheel in accordance with the present invention.

Referring to FIGS. 4 and 5, the ratchet wheel 20 is rotatably mounted in the first housing 11 of the main body 10 and the pawl 30 is lodged within the second housing 12. The first end 41 of the elastic element 40 is held against the wall of the second housing 12 and the second end 42 is held within the recess 35 of the pawl 30. The second convex surface 341 is abutted against the second housing 12 and the first retaining cogs 31 of the pawl 30 are engaged with the ratchet teeth 21. In FIG. 8, it shows the state of the first retaining cogs 31 of the pawl 30 disengaging from the ratchet teeth 21.

Figure 6:
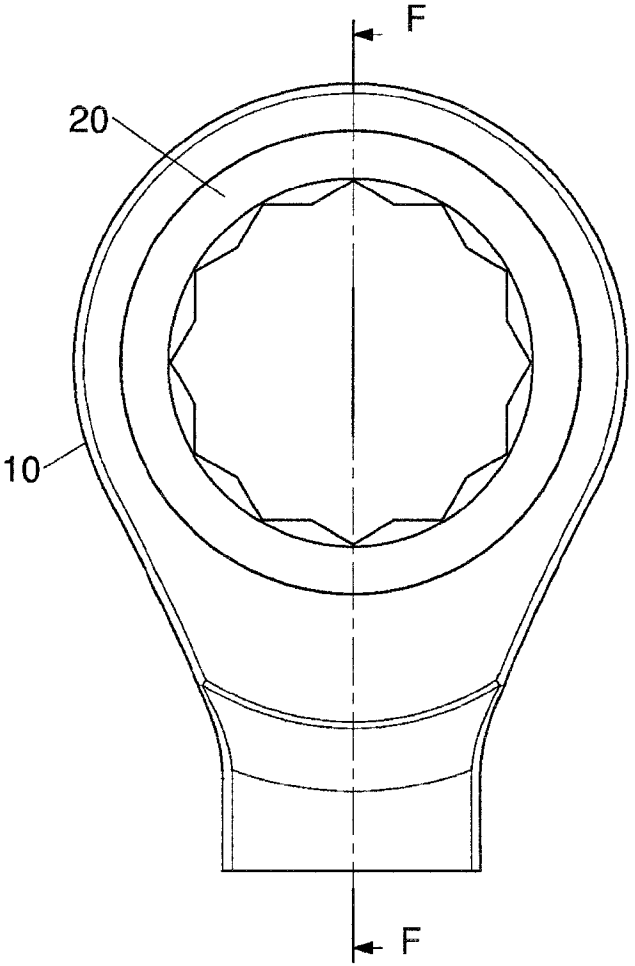
FIG. 6 is a front view of the present invention.
Figure 7:
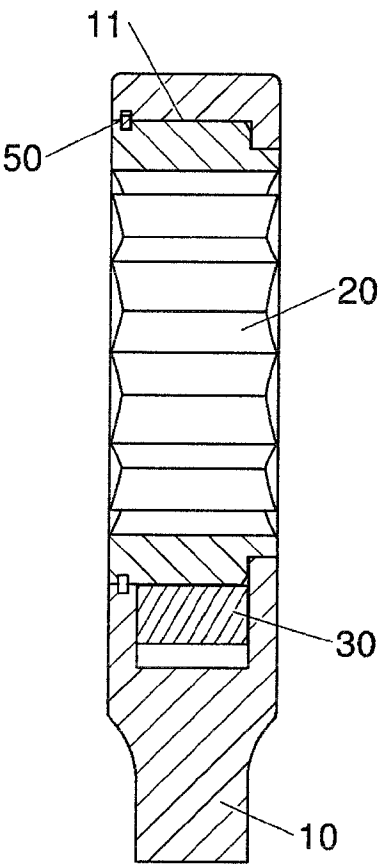
FIG. 7 is a cross-sectional view taken along plane F-F in FIG. 6.

Referring to FIGS. 6 and 7, the clamping trough 23 is exactly paired with the annular trough 13 and the annular groove 24 allows the annular flange 14 to be engaged in. The clip 50 is lodged in both the annular trough 13 and the clamping trough 23. The ratchet wheel 20 is rotatably positioned in the first housing 11.

Referring to FIGS. 1 and 2, the cross section of the recess 35 is an arc and the elastic element 40 is tapered with the outer diameter of the first end 41 greater than the outer diameter of the second end 42.

Figure 9:
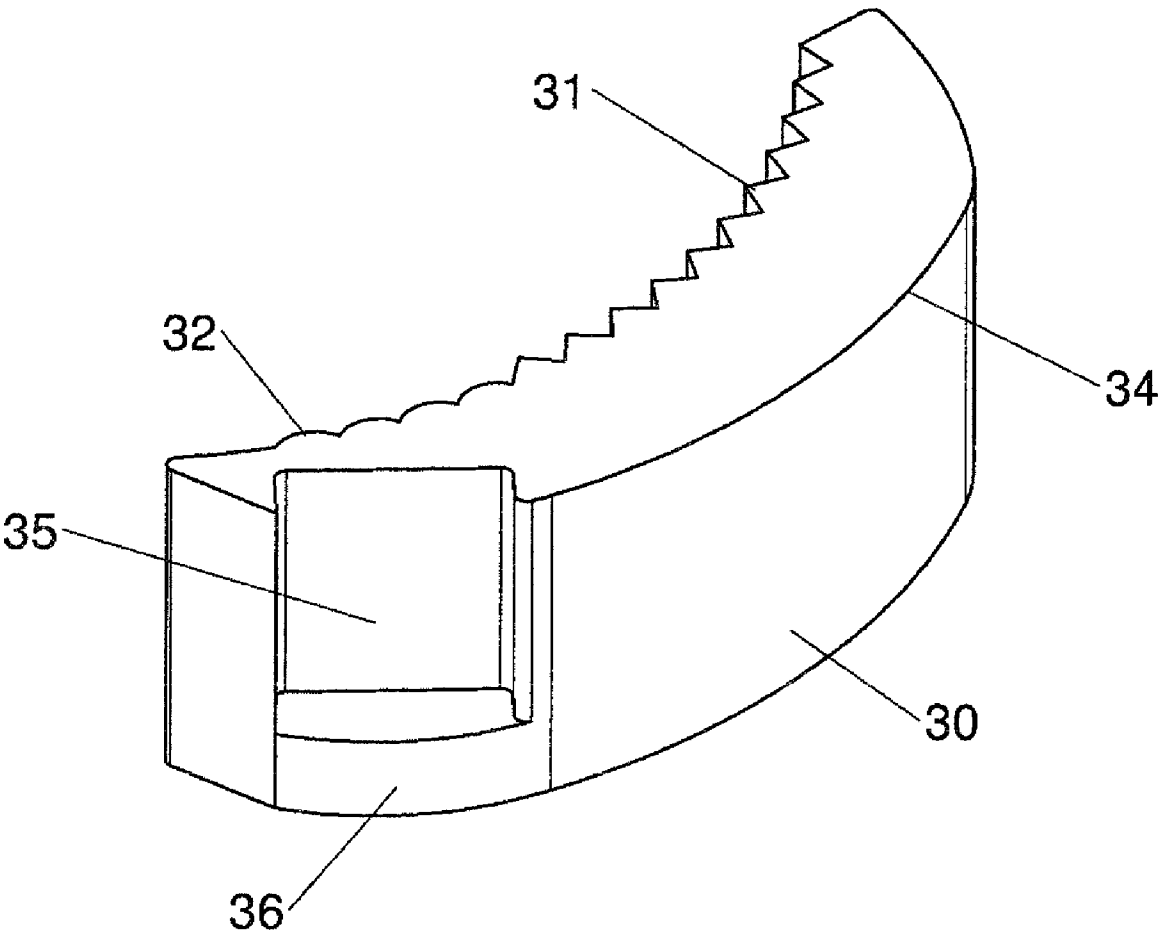
FIG. 9 is a perspective drawing of the pawl of another embodiment in accordance with the present invention.

Referring to FIG. 9, the recess 35 has an opening at its upper portion and a closed base 36 as its bottom portion in order to enhance the strength of the structure.

Figure 10:
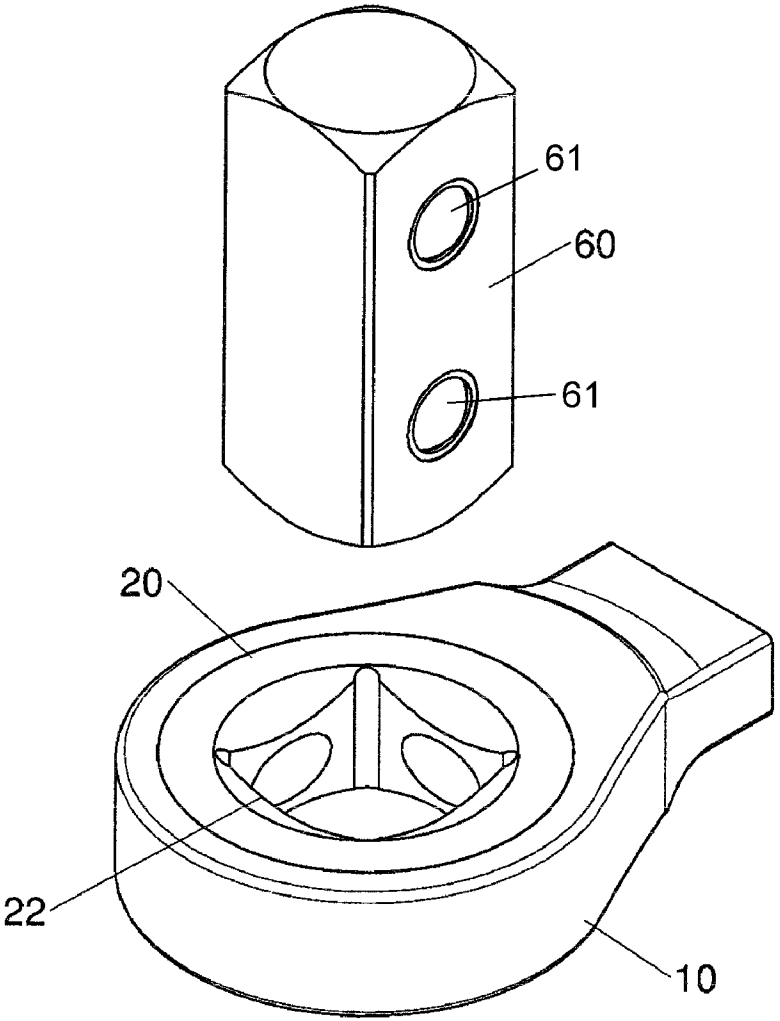
FIG. 10 is a perspective drawing of the coupling portion of another embodiment in accordance with the present invention.
Figure 11:
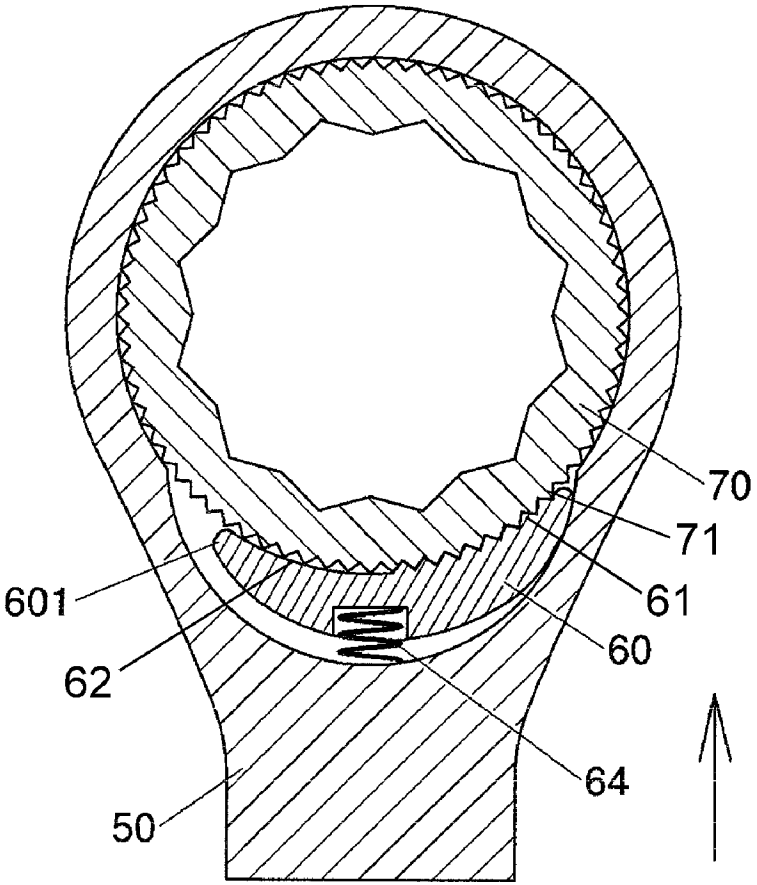
PRIOR ART FIG. 11
FIG. 11 is a cross sectional view of a ratchet wrench in accordance with the prior art.
Figure 12:
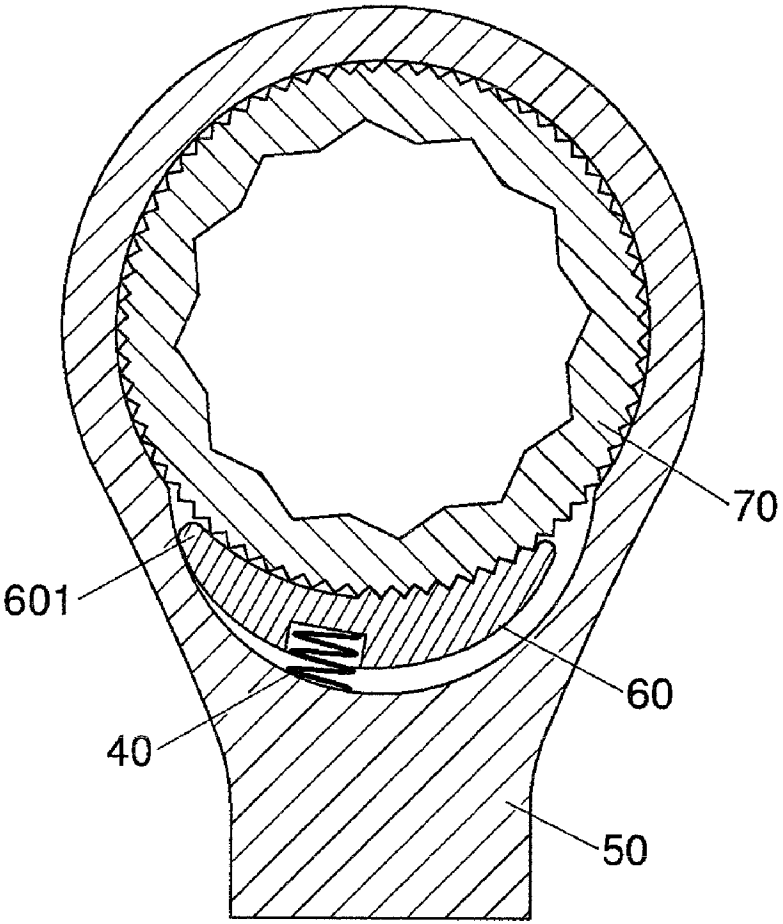
PRIOR ART FIG. 12
FIG. 12 is a cross sectional view of the pawl engaging with the ratchet wheel in accordance with the prior art.
Figure 13:
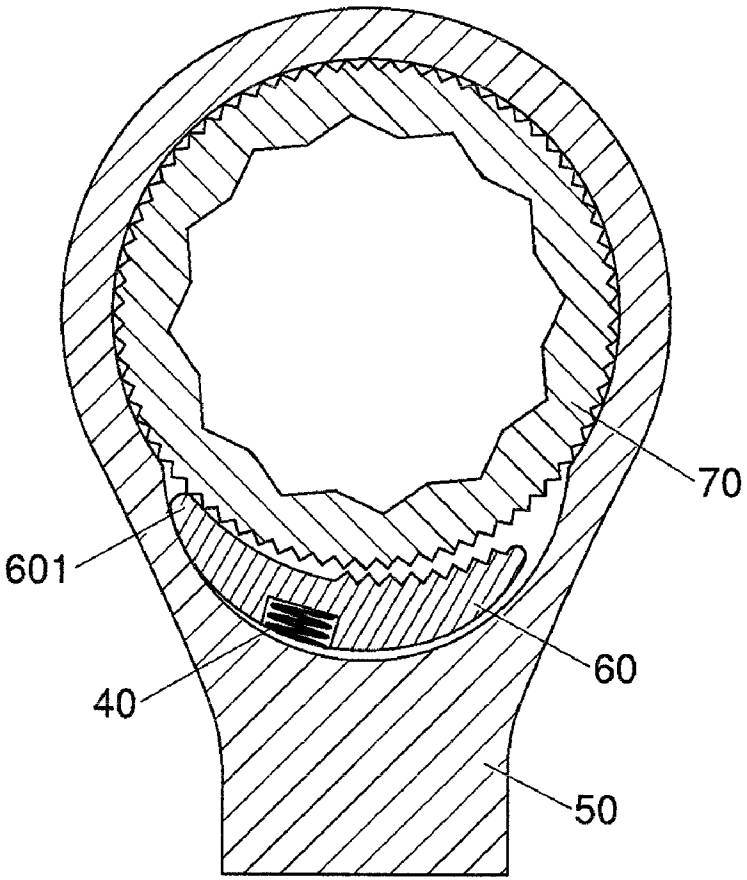
PRIOR ART FIG. 13
FIG. 13 is a cross sectional view of the pawl disengaging from the ratchet wheel in accordance with the prior art.

Referring to FIG. 10, the couple portion 22 is square with four holes on its four sidewalls for a square column 60 to be coupled. Each side of the square column 60 has two protruded spheroids 61 which one of them couples with the sidewall of couple portion 22 and the other one couples with the inner wall of a socket (does not shown in the drawing).

Based upon above designs, the advantages of the present invention are summarized as bellow:

1. In the present invention, the mechanism of the ratchet wheel comprises only five components: a main body 10, a ratchet wheel 20, a pawl 30, an elastic element 40 and a clip 50. Comparing with the design disclosed in the U.S. Pat. No. 7,444,903 B1, the cost of components can be reduced.

2. In the present invention, the recess 35 is deep and its cross section is an arc. The elastic element 40 is tapered with a longer length and it pushes the pawl 30 with an N3 angle. Therefore, the bevel elasticity can easily make the second convex surface 341 tightly abut against the wall of the second housing 12 and make the first retaining cogs 31 engage with the ratchet teeth 21 more precisely.

3. When the wrench revolves counterclockwise against the ratchet wheel 20, the elastic element 40 abuts the recess 35 of the pawl 30 with an angle N3 in order to allow the pawl 30 to be effectively disengaged from the ratchet wheel 20 and to provide a ratchet wheel mechanism with more precise and effective function.

4. In the present invention shown as FIG. 2, the pawl 30 has a recess 35 for the elastic element 40 to be lodged in. The pawl 30 is one-piece manufactured. It does not require drilling, so the cost of manufacturing can be reduced.

5. In the present invention shown as FIG. 7, the diameter of the first end 41 of the elastic element 40 matches the width of the second housing 12 and the second end 42 lodges within the recess 35. It does not require drilling a hole from another component to lodge the elastic element 40, and the elastic element 40 can be steadily lodged within the second housing 12.

6. In the present invention, the pawl 30 has a second convex surface 341 which is steadier abutted against the second housing 12 with an N1 angle.

While we have shown and described the embodiment in accordance with the present invention, it should be clear to those skilled in the art that further embodiments may be made without departing from the scope of the present invention.

What is claimed is:

1. A ratchet wrench comprising:

a main body having a handle at one end and a function end at the other, the function end having a round first housing opened in its middle, on the wall of the first housing being sunk a curved second housing, the center of the second housing being located inside the first housing, and both the top and the bottom portions of the second housing being confined;

a ratchet wheel being rotatably mounted in the first housing, the outer periphery of the ratchet wheel having a plurality of ratchet teeth annularly arranged at its middle portion, and the center of the ratchet wheel having a couple portion;

a pawl lodged in the second housing having a plurality of first retaining cogs, a plurality of curved second retaining cogs and a first concave surface successively arranged on its front side and distributed along a first arc which has the same diameter as the first housing, the first retaining cogs and the second retaining cogs being defined to engage with the ratchet teeth, the tips of the first retaining cogs distributing on a third arc and the tips of the second retaining cogs distributing on a fourth arc, at least two teeth of the first retaining cogs passing a bisector of the first arc and being followed by the second retaining cogs as the pawl and the ratchet wheel being effectively engaged together, the central angle of the second retaining cogs extended along the first arc being less than or equal to 20 degrees, on the rear side of the pawl being a first convex surface which has a first end and a second end defined in opposite directions, the first end extending a second convex surface towards the front side of the pawl and the second end extending a recess, the second convex surface spanning a central angle N2 with respect to the center of the first arc, the second convex surface being on a second arc and against the wall of the second housing, the second arc having the same diameter as the second housing, between the second arc and the second end of the first convex surface being a gap which is larger than the depth of the first retaining cog, the recess being corresponding to the second retaining cogs, a normal extended from the middle of the bottom of the recess passing through the center of the second arc, and the normal and the bisector of the first convex surface having an included angle N3; and an elastic element having a first end and a second end, the outer diameter of the first end being greater than or equal to the vertical depth of the second housing in order for the first end to be held against the second housing and for the second end to be held within the recess, and the elastic element pushing the pawl so that the second convex surface being forced to abut against the wall of the second housing and the first retaining cogs of the pawl being engaged with the ratchet teeth.

2. The ratchet wrench as claimed in claim 1, wherein the elastic element is tapered with the outer diameter of the first end greater than the outer diameter of the second end.

3. The ratchet wrench as claimed in claim 1, wherein the couple portion is a polygonal opening for a workpiece to be coupled.

4. The ratchet wrench as claimed in claim 3, wherein the polygonal opening is square with four holes on its four sidewalls for a square column to be coupled, and each side of the square column has two protruded spheroids which one of them couples with the sidewall of couple portion and the other one couples with the inner wall of a socket.

5. The ratchet wrench as claimed in claim 1, wherein the diameter of the fourth arc is half of the sum of the first arc's and the third arc's diameters.

6. The ratchet wrench as claimed in claim 1, wherein the recess has an opening at its upper portion and a closed base as its bottom portion.

7. The ratchet wrench as claimed in claim 1, wherein a plurality of curved second retaining cogs and a first concave surface successively arranged on the front side of the pawl and the first concave surface is distributed along the first arc.

8. The ratchet wrench as claimed in claim 1, wherein the included angle N3 is greater than 40 degrees.

9. The ratchet wrench as claimed in claim 1, wherein the central angle N2 spans between 10 to 20 degrees.

10. The ratchet wrench as claimed in claim 1, wherein an annular trough is defined at the inner top portion of the first housing and an annular flange at the bottom; a clamping trough and an annular groove are respectively notched at the top and the bottom portions of the ratchet wheel, the clamping trough is exactly paired with the annular trough for a C-clip to lodge in, and the annular flange lodges in the annular groove in order for the ratchet wheel to be positioned in the first housing.

* * * * *